US007670170B2

(12) United States Patent
Henry et al.

(10) Patent No.: US 7,670,170 B2
(45) Date of Patent: Mar. 2, 2010

(54) CONNECTOR ASSEMBLY HAVING A LIGHT PIPE ASSEMBLY

(75) Inventors: Randall R. Henry, Harrisburg, PA (US); Michael J. Phillips, Camp Hill, PA (US); David A. Griesemer, Harrisburg, PA (US); Rodney S. Smith, Boiling Springs, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/113,085

(22) Filed: Apr. 30, 2008

(65) Prior Publication Data

US 2009/0274422 A1 Nov. 5, 2009

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS

| | | | | |
|---|---|---|---|---|
| 5,741,152 | A | 4/1998 | Boutros | |
| 5,790,041 | A | 8/1998 | Lee | |
| 6,095,851 | A * | 8/2000 | Laity et al. | 439/490 |
| 6,113,422 | A | 9/2000 | Somerville et al. | |
| 6,257,906 | B1 | 7/2001 | Price et al. | |
| 6,483,712 | B1 * | 11/2002 | Oliphant et al. | 361/737 |
| 6,623,292 | B1 | 9/2003 | Holler et al. | |
| 2005/0032415 | A1 * | 2/2005 | Sakamoto | 439/490 |
| 2007/0059975 | A1 | 3/2007 | Walsh | |

FOREIGN PATENT DOCUMENTS

| | | |
|---|---|---|
| DE | 100 13 864 A1 | 10/2001 |
| WO | WO 00/17968 | 3/2000 |
| WO | WO 2005/106899 A1 | 11/2005 |

OTHER PUBLICATIONS

European Search Report, European Application No. EP 09 15 9091, European Filing Date Aug. 27, 2009.

* cited by examiner

*Primary Examiner*—Tho D Ta

(57) ABSTRACT

A connector assembly includes a first connector having a housing and a plurality of contacts extending from the housing. The housing and the contacts define a mating interface and the first connector includes a light source. A second connector has a housing and a plurality of contacts defining a mating interface configured to mate with the mating interface of the first connector. The connector assembly also includes a light pipe assembly having a plurality of separate light pipe segments, wherein a first light pipe segment is provided with the first connector and directs light from the light source, and a second light pipe segment is provided with the second connector and receives light from the first light pipe segment to direct light to an external portion of the second connector.

20 Claims, 7 Drawing Sheets

CONNECTOR ASSEMBLY HAVING A LIGHT PIPE ASSEMBLY

BACKGROUND OF THE INVENTION

The subject matter herein relates generally to a connector assembly, and more particularly, to a connector assembly having a light pipe assembly.

In the electronics industry, and in particular the telecommunications industry, there is an increasing trend towards smaller electrical connectors, particularly cable mounted plugs. The industries are also trending to more densely packaged connectors and connector systems. For example, in switching networks, such as patch panels, the connectors are positioned in multiple rows in tightly spaced areas. Other examples include computers having multiple ports arranged on a panel. The ports are typically arranged in a plurality of rows that are spaced close to one another.

Connector assemblies typically include two connectors, such as a plug connector and a receptacle connector, that are mated with one another. At least some known connector assemblies include indicator lights that indicate an operating status of the connector assembly. For example, a light source is provided on one of the connectors, typically the receptacle connector. The light source is operated to indicate the operating status of the receptacle connector and/or the plug connector. For example, the light source is illuminated when data is being transmitted, or the light source may be illuminated when an error has occurred in the transmission of data. The light source may also indicate when the plug connector and the receptacle connector are properly mated with one another. The light source is typically positioned proximate an external wall of the device or panel housing the receptacle connector. As such, the light emitted from the light source may be viewed by a technician when looking at the device or panel. However, due to the decrease in size of the connectors and/or because the rows are positioned in such close proximity, space on the surface of the device and/or panel is limited. Difficulties arise for the technician in viewing the light from the light sources. Additionally, the plug connectors and/or the cabling of the plug connectors may block a line of sight of the technician to the light source.

A need remains for a connector assembly that may provide status indication in an efficient manner. A need remains for a means for a technician to easily view light from a light source of the connector system.

BRIEF DESCRIPTION OF THE INVENTION

In one embodiment, a connector assembly is provided including a first connector having a housing and a plurality of contacts extending from the housing. The housing and the contacts define a mating interface and the first connector includes a light source. A second connector has a housing and a plurality of contacts defining a mating interface configured to mate with the mating interface of the first connector. The connector assembly also includes a light pipe assembly having a plurality of separate light pipe segments, wherein a first light pipe segment is provided with the first connector and directs light from the light source, and a second light pipe segment is provided with the second connector and receives light from the first light pipe segment to direct light to an external portion of the second connector.

Optionally, the first connector may define a receptacle and the second connector may define a plug. The second connector may have a cable end mounted to an end of a cable and the second light pipe segment directs the light to the cable end.

Each light pipe segment may extend between opposed ends, wherein the first end of the first light pipe segment receives light from the light source, and wherein the first end of the second light pipe segment faces the second end of the first light pipe segment and receives light from the first light pipe segment. Optionally, the first light pipe segment may interface with the second light pipe segment. Optionally, the first light pipe segment may be spaced apart from the second light pipe segment, and the light pipe assembly may include a third light pipe segment positioned between the first and second light pipe segments. The third light pipe segment may be integrally formed with the housing of one of the first and second connectors.

In another embodiment, an electrical connector is provided including a housing having a mating end and a cable termination end being configured to be coupled to an end of a cable. The mating end is configured to mate with a mating connector having a light pipe directing light from a light source. A boot surrounds at least a portion of the housing and includes a front end and a rear end. The rear end of the boot is configured to be coupled to the cable. A light pipe extends between the front end and the rear end of the boot. The light pipe is configured to be aligned with the light pipe of the mating connector to direct light from the light pipe of the mating connector to the rear end of the boot.

In a further embodiment, a connector assembly is provided that includes first and second connectors mated with one another, wherein the first connector having a light source. The connector assembly also includes a light pipe assembly having a first light pipe segment received within the first connector and a second light pipe segment received within the second connector. The first and second light pipe segments optically communicate with one another to direct light from the light source to an external portion of the second connector. A portion of the second connector is positioned between the first light pipe segment and the second light pipe segment.

DETAILED DESCRIPTION OF THE INVENTION

Figure 1:
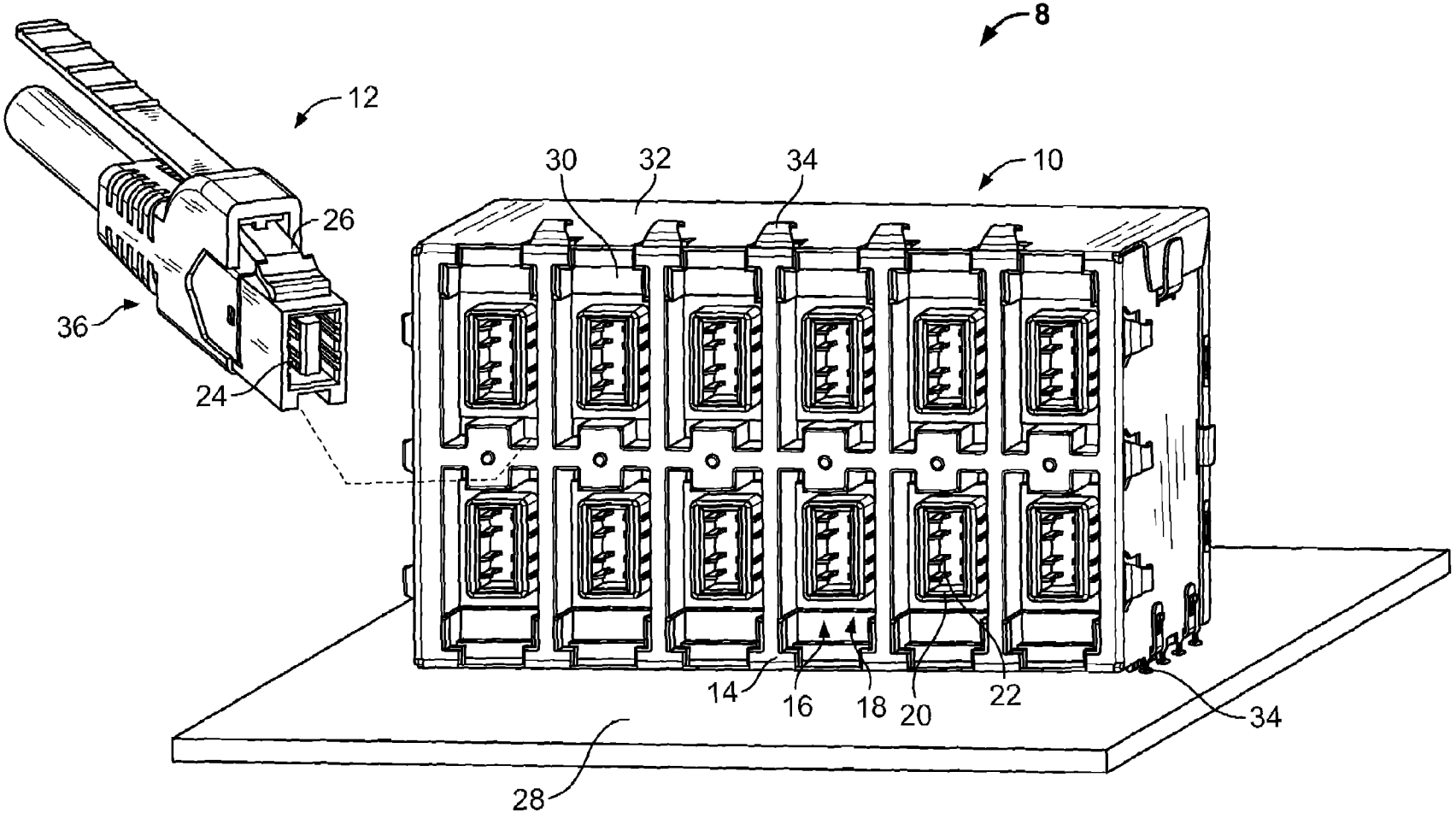
FIG. 1 is a perspective view of an exemplary connector assembly having first and second connectors formed in accordance with an exemplary embodiment.

FIG. 1 is a perspective view of an exemplary connector assembly 8 formed in accordance with an exemplary embodiment. The connector assembly 8 includes a first connector 10 and a second connector 12. In the illustrated embodiment, the first connector 10 represents a receptacle connector or jack, and may be referred to hereinafter as receptacle connector 10. The second connector represents a plug connector or plug, and may be referred to hereinafter as plug connector 12. The receptacle connector 10 receives the plug connector 12 during a mating operation.

In an exemplary embodiment, the first and second connectors 10, 12 are modular connectors, such as the types of electrical connectors used for connecting telecommunications equipment or computer networking equipment. In the illustrated embodiment, the first and second connectors 10, 12 are eight pin, eight conductor (8P8C) modular connectors having signal pairs, however the subject matter described herein also has applicability to other connectors having fewer or greater numbers of pins, conductors and/or signal pairs. Additionally, the subject matter described herein also has applicability to other types of connectors used within the telecommunications industry, such as RJ-45 type connectors, and to other types of connectors used in other industries, such as the computer industry, such as connectors for interfacing devices, like USB connectors, SFP connectors, and the like.

In an exemplary embodiment, the receptacle connector 10 includes a housing 14 having multiple communication ports 16 opening to cavities 18 that receive respective ones of the plug connectors 12. The receptacle connector 10 also includes contact sub-assemblies 20 that are arranged within respective ones of the cavities 18. Each of the contact sub-assemblies 20 includes a plurality of mating contacts 22 arranged along a mating interface for mating with corresponding contacts 24 of the plug connector 12. For example, the mating contacts 22 and the contacts 24 are arranged in similar patterns for mating engagement. Optionally, the mating contacts 22 and contacts 24 are arranged, or grouped, as differential signal pairs. In an exemplary embodiment, the plug connector 12 includes a latch 26 on an exterior surface thereof for securing the plug connector 12 within the cavity 18.

The housing 14 is mounted to a substrate 28. Optionally, the substrate 28 may represent a circuit board and the electrical connector may be mechanically and electrically connected to the circuit board for sending and receiving signals. The substrate 28 and receptacle connector 10 may be mounted within an electrical device or apparatus having a communications port through which the device may communicate with other externally networked devices. Alternatively, the receptacle connector 10 may be wall mounted or panel mounted for connection with the plug connectors 12. In some embodiments, the receptacle connector 10 may include only a single cavity 18 and corresponding contact sub-assemblies 20 for mating with a single plug connector 12. Additionally, in some embodiments, rather than sending and receiving the signals via a circuit board, the receptacle connector 10, or more particularly, the contacts 22, may be terminated to an end of a cable (not shown).

In an exemplary embodiment, the housing 14 includes a dielectric body 30 that defines the cavities 18. A cover 32 at least partially surrounds the body 30 and the contact sub-assemblies 20. Optionally, the cover 32 may be metallic and may define a shield, such as an electromagnetic interference (EMI) shield. The cover 32 includes mounting tabs 34 for mounting to the substrate 28. For example, the mounting tabs 34 may be eye-of-the-needle pins that are pressed into the substrate 28 for mechanically and electrically connecting the cover 32 to the substrate 28. In an exemplary embodiment, the connector assembly 8 may include a light pipe assembly 36, described in further detail below, for identifying a connectivity or operational state of the receptacle connector 10 and/or the plug connector 12 associated therewith. Optionally, the light pipe assembly 36 may include a plurality of segments that cooperate with one another to direct light through the connector assembly 8. The receptacle connector 10 and/or the plug connector 12 may include segments of the light pipe assembly 36.

Figure 2:
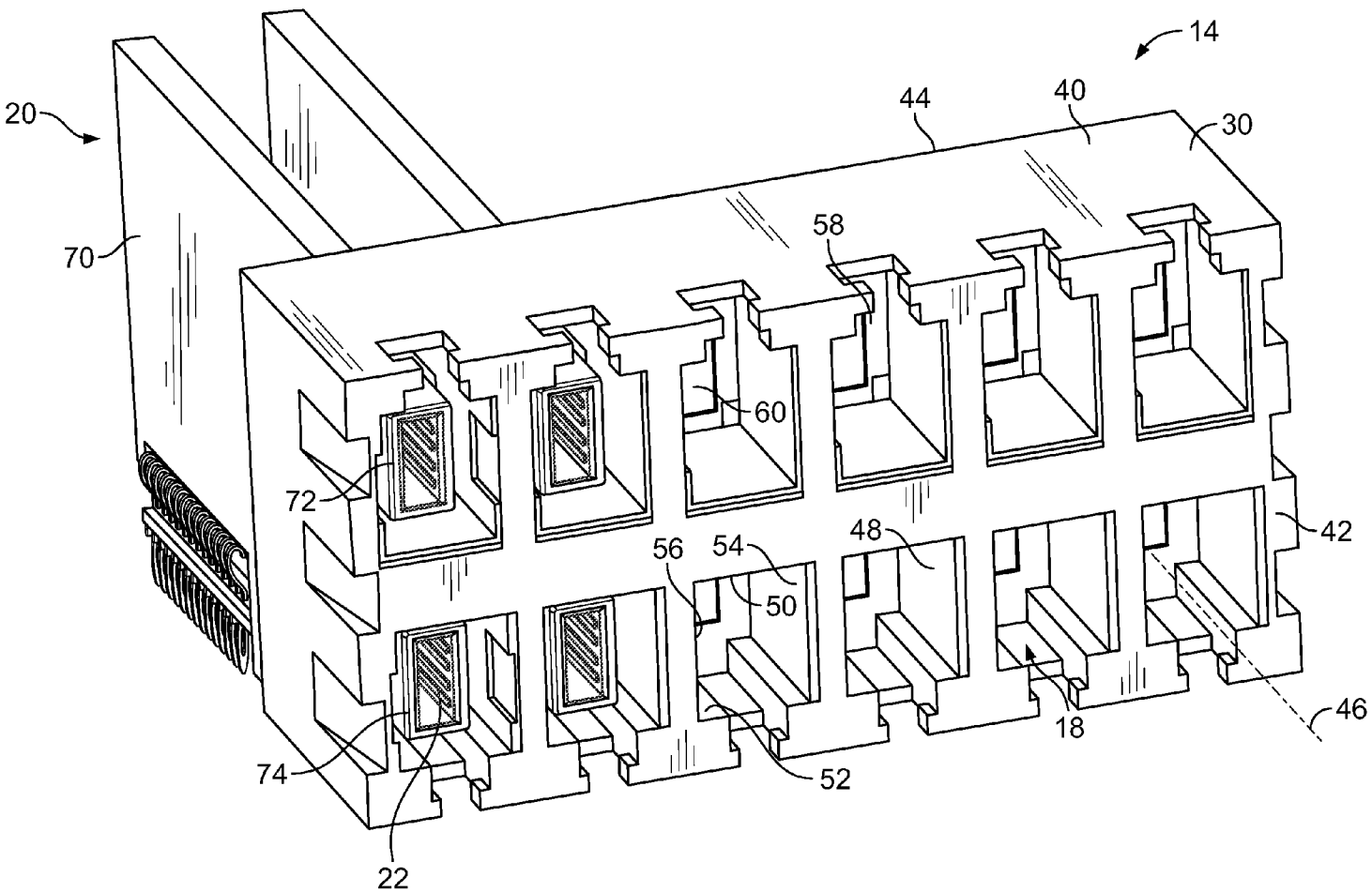
FIG. 2 is a front perspective view of a portion of the first connector shown in FIG. 1.

FIG. 2 is a front perspective view of the housing 14 with the cover 32 (shown in FIG. 1) removed and a plurality of the contact sub-assemblies 20 coupled to the housing 14. The housing body 30 includes outer walls 40 that define a perimeter of the housing body 30. The outer walls 40 extend between a mating end 42 and a terminating end 44 of the housing body 30. The cavities 18 are open at the mating end 42 for receiving the plug connectors 12 (shown in FIG. 1), and each extends along a cavity axis 46 at least partially between the mating end 42 and the terminating end 44. Optionally, the plug connector 12 may be loaded into the cavity 18 in a direction substantially parallel to the cavity axis 46. In the illustrated embodiment, the cavities 18 are arranged in two rows and six columns, however, fewer or greater rows and/or columns of cavities 18 may be provided in alternative embodiments.

The cavities 18 are defined by inner walls 48 of the housing body 30. In the illustrated embodiment, the inner walls 48 define a cavity 18 having a rectangular cross-section with an upper wall 50, a lower wall 52, and opposed side walls 54, 56. However, the cavities 18 may have alternative shapes, including non-planar wall surfaces, in alternative embodiments. The inner walls 48 also define a bottom wall 58 along the terminating end 44. An opening 60 extends through the bottom wall 58, and a portion of the contact sub-assembly 20 extends through the opening 60 into the cavity 18.

The contact sub-assemblies 20 generally include the contacts 22 and a sub-structure for supporting or holding the contacts for mating engagement with the plug connector 12 as well as for terminating, or otherwise interconnecting, the contacts 22 with a mating component, such as the substrate 28 (shown in FIG. 1) or individual wires of a cable (not shown). Exemplary contact sub-assemblies 20 are illustrated in FIG. 2, as including a base 70, a first contact support member 72 and a second contact support member 74. In an exemplary embodiment, the base 70 is a circuit board, and may be referred to hereinafter as base 70. The contacts 22 are terminated to the base 70. However, in alternative embodiments, such as an embodiment wherein the contact sub-assembly is terminated directly to a cable, the base 70 may be a different component, such as a housing component that is used to mount to the end of the cable. For example, the base 70 may be formed as part of, or may be used in conjunction with, the housing body 30 (shown in FIG. 2) and may be mounted to the end of the cable.

Both contact support members 72, 74 are coupled to the base 70 and are arranged in a stacked configuration. Each contact support member 72, 74 supports a set of the contacts 22 that are used for interfacing with a different plug connector 12 (shown in FIG. 1). Additionally, each contact support member 72, 74 and corresponding set of contacts 22 are received within a different cavity 18 (shown in FIGS. 1 and 2) for interfacing with the corresponding plug connector 12. While two contact support members 72, 74 are illustrated in the embodiment shown in FIG. 2, it is realized that more or less than two contact support members may be provided in alternative embodiments. For example, the number of contact support members may depend on the number of cavities 18 arranged in one of the columns of cavities of the housing 14 (shown in FIG. 2). Similarly, the housing 14 may only include a single row of cavities 18, or possibly only a single cavity 18, in which case, the contact sub-assembly 20 may only include a single contact support member and corresponding set of contacts 22.

Figure 3:
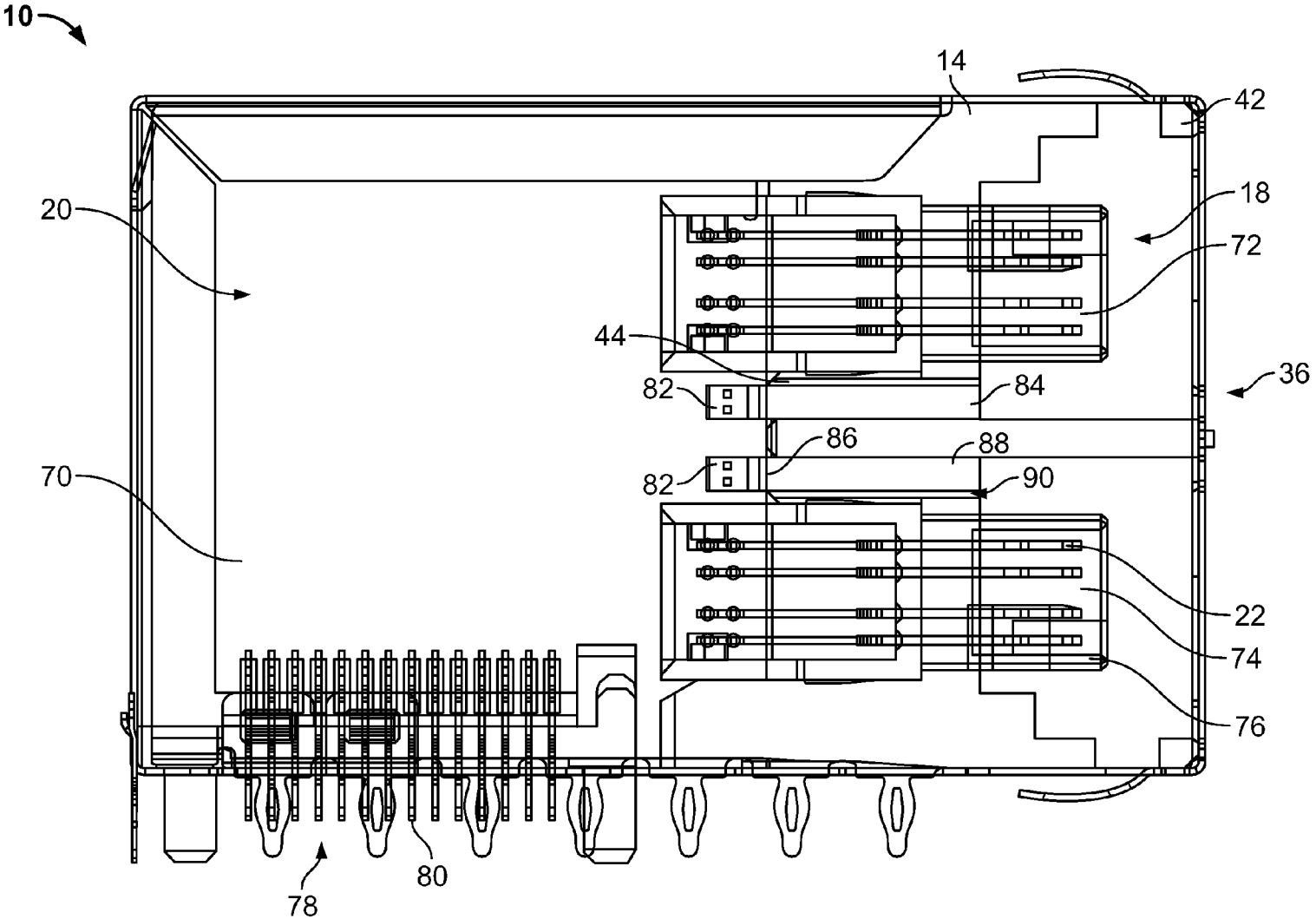
FIG. 3 is a side, partial cut-away view of the first connector.

FIG. 3 is a side, partial cut-away view of the receptacle connector 10 illustrating one of the contact sub-assemblies 20 coupled to the housing 14. In an exemplary embodiment, each contact support member 72, 74 includes a header 76 for supporting the contacts 22. The header 76 is coupled to the base 70 and supports the contacts 22 along a length of the contacts 22. The contacts 22 are terminated to the base 70. The contacts 22 may be arranged as differential pairs of contacts in an exemplary embodiment. The contacts 22 forming each differential pair are closely spaced with respect to one another to provide adequate inductive coupling between the contacts 22.

In the illustrated embodiment, the contact sub-assembly 20 includes a mounting interface 78 that is mounted to a mounting component, such as the substrate 28 (shown in FIG. 1). The mounting component may be a cable or other component or device in alternative embodiments. A plurality of mounting contacts 80 are provided at the mounting interface 78. The mounting contacts 80 are electrically coupled to corresponding ones of the contacts 22, such as by traces on the base 70. The mounting contacts 80 extend from the base 70 for electrically connecting to the mounting component.

In an exemplary embodiment, the contact sub-assembly 20 includes at least one light source 82, such as a light emitting diode (LED) mounted to the base 70. For example, at least one light source 82 may be mounted proximate to, and may correspond to, each contact support member 72, 74. In the illustrated embodiment, the light sources 82 are positioned adjacent one another between the respective contact support members 72, 74 at an edge of the base 70. In an alternative embodiment, the light source 82 associated with the upper contact support member 72 may be positioned generally above the contact support member 72 rather than below the contact support member 72. Similarly, the light source 82 associated with the lower contact support member 74 may be positioned generally below the contact support member 74 rather than above the contact support member 74. The light sources 82 may be electrically connected to circuitry on the base 70. The circuitry may be connected to the mounted contacts 80 and controlled based on signals received by certain mounting contacts 80.

The receptacle connector 10 includes at least a portion of the light pipe assembly 36. For example, for each light source 82, a light pipe segment 84 is provided. The light pipe segment 84 extends between an inlet end 86 and an outlet end 88. In an exemplary embodiment, the light pipe segment 84 extends along a linear axis between the inlet and outlet ends 86, 88. The light pipe segment 84 is substantially aligned with the light source 82 and the inlet end 86 faces the light source 82. The inlet end 86 generally faces the light source 82 and receives light from the light source 82. Optionally, the inlet end 86 may be positioned immediately adjacent the light source 82 and/or engage a portion of the light source 82. The light pipe segment 84 directs the light to the outlet end 88.

In an exemplary embodiment, the light pipe segment 84 extends through the housing 14. For example, the housing 14 may include a channel 90 therethrough. The light pipe segment 84 is received in the channel 90. In an exemplary embodiment, the light pipe segment 84 extends from the terminating end 44 of the housing to the cavity 18. Optionally, the light pipe segment 84 may extend outward from the terminating end 44. The light pipe segment 84 may extend at least partially into the cavity 18. In one embodiment, the light pipe segment 84 extends proximate to the mating end 42. In operation, prior to loading the plug connector 12 (shown in FIG. 1) into the cavity 18, the outlet end 88 of the light pipe segment 84 may be visible from outside the receptacle connector 10, such as through the cavity 18.

In an alternative embodiment, rather than the light pipe segment 84 being a separate component received in the housing 14, the housing 14, or at least a portion thereof, may form the light pipe segment 84. For example, the housing 14 may be fabricated from a material that is at least partially transparent such that the light emitted from the light source 82 is directed through the housing 14. In one embodiment, the material may be a clear polycarbonate material. Optionally, the entire housing 14 may be fabricated from such material. Alternatively, the housing 14 may include such material in the area of the light pipe segment 84 illustrated in FIG. 3, or similar areas.

Figure 4:
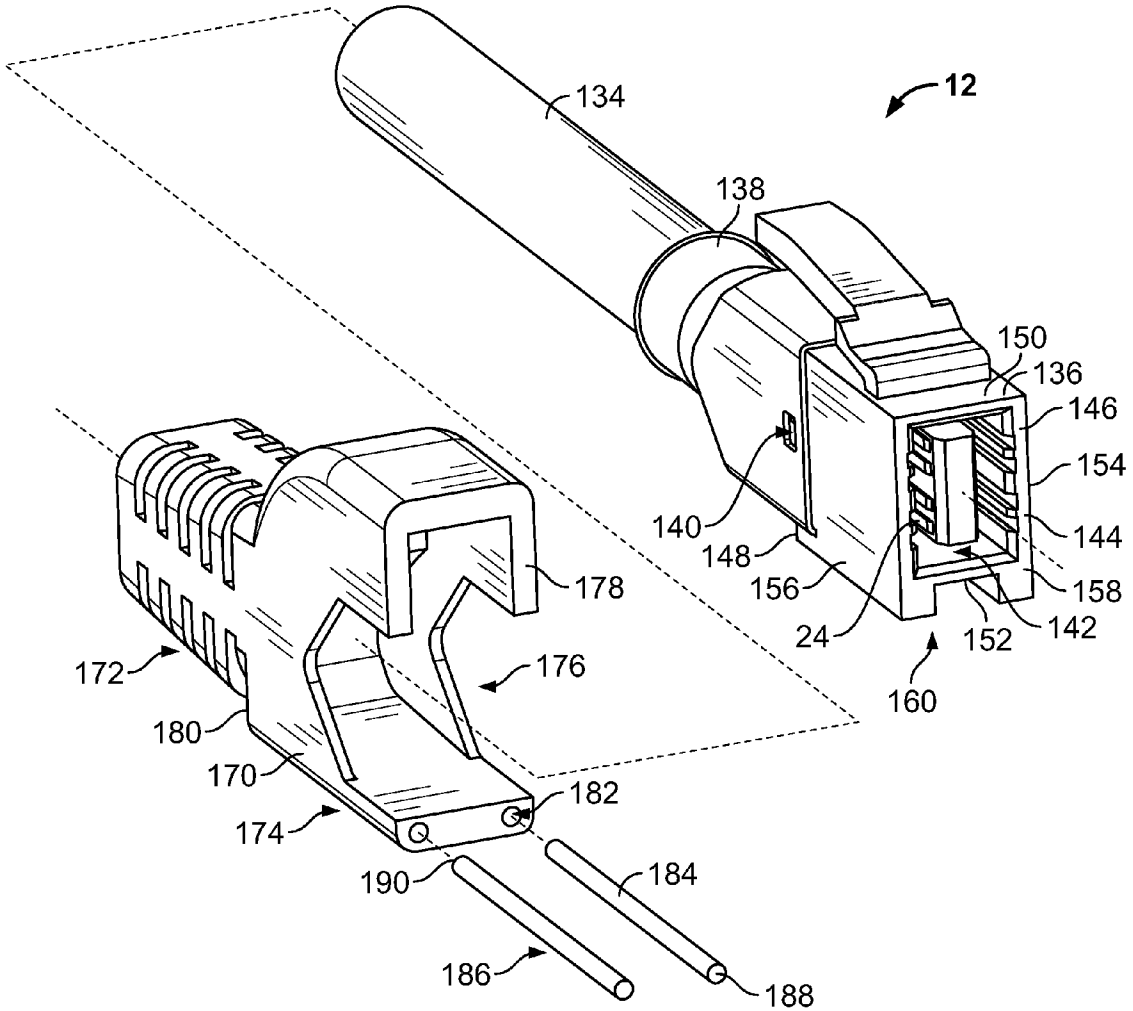
FIG. 4 is an exploded perspective view of the second connector shown in FIG. 1.

FIG. 4 is an exploded perspective view of the plug connector 12. The plug connector 12 is coupled to an end of a cable 134. The plug connector 12 includes a housing 136 and a ferrule 138 extending from the housing 136. The ferrule 138 is coupled to the housing 136 using a latching mechanism 140, or other type of fastener. The ferrule 138 surrounds the cable 134 and the individual wires (not shown) that form the cable 134. The ferrule 138 is securely coupled to the cable 134 to resist removal of the cable 134 from the plug connector 12. For example, a portion of the ferrule 138 may be crimped, or otherwise secured to, the cable 134. Optionally, the ferrule 138 may be fabricated from a metal material and the ferrule 138 may provide shielding around the end of the cable 134 and the wires of the cable 134.

The housing 136 has a cavity 142 defined by outer walls 144 that define a perimeter of the housing 136. The contacts 24 are provided within the cavity 142 for interfacing with the mating contacts 22 (shown in FIG. 1) of the receptacle connector 10 (shown in FIG. 1). The outer walls 144 extend between a mating end 146 and a cable end 148 of the housing 136. The contacts 24 may be terminated to individual wires (not shown) of the cable 134 proximate the cable end 148 of the housing 136. In an exemplary embodiment, the outer walls 144 include a top wall 150, a bottom wall 152 and opposed side walls 154, 156. Other configurations are possible in alternative embodiments. In one embodiment, the housing 136 is fabricated from a non-conductive material, such as plastic, and is molded into form.

In an exemplary embodiment, the housing 136 includes leg portions 158 at the bottom wall 152. The leg portions 158 extend between the mating end 146 and the cable end 148 of the housing 136. The leg portions 158 are separate from one another such that a gap is defined therebetween. Alternatively, the leg portions 158 may be joined with one another along the length such that the housing 136 has a flat bottom. In an exemplary embodiment, the leg portions 158 define a light pipe segment 160 of the light pipe assembly 36 (shown in FIG. 1). As such, the housing 136 defines a portion of the light pipe assembly 36. For example, the leg portions 158 may define windows that allow the transmission of light therethrough. The leg portions 158 may be fabricated from a material that is at least partially optically transparent such that light may be directed therethrough. In one embodiment, the material may be a clear polycarbonate material. Optionally, the entire housing 136 may be fabricated from such material. Alternatively, only the leg portions 158 may include such material in the area of the light pipe segment 84 illustrated in FIG. 4, or similar areas.

In an alternative embodiment, rather than the leg portions 158 defining the light pipe section 160, discrete light pipes may be provided within or otherwise be coupled to the housing 136. For example, light pipes may extend within channels formed in the housing 136, such as in the area of the leg portions 158.

In operation, when the plug connector 12 is mated with the receptacle connector 10, the light pipe segment 160 is substantially aligned with the corresponding light pipe segment 84 (shown in FIG. 3) in the receptacle connector 10. Light emitted from the light pipe segment 84 in the receptacle connector 10 is received by, and directed through, the light pipe segment 160 in the plug connector 12.

The plug connector 12 includes a boot 170 the surrounds at least a portion of the housing 136 and/or the ferrule 138. The boot 170 includes a strain relief portion 172 that surrounds, and is coupled to, the cable 134. The strain relief portion 172 is provided at a rear of the boot 170. The boot 170 also includes a connector portion 174 with a cavity 176 that surrounds at least a portion of the housing 136 and/or the ferrule 138. The connector portion 174 is provided at a front of the boot 170. Optionally, the connector portion 174 may be securely coupled to the housing 136 and/or the ferrule 138, such as by a friction fit, a mechanical fastener, an adhesive, and the like.

The connector portion 174 of the boot 170 extends between a front end 178 and a rear end 180. The strain relief portion 172 extends rearward from the rear end 180. The connector portion 174 includes channels 182 that extend between the front end 178 and a rear end 180. The channels 182 receive light pipes 184 that form light pipe segments 186 of the light pipe assembly 36. The light pipes 184 extend between front and rear ends 188, 190. In an exemplary embodiment, the light pipes 184 may be fabricated from a material that is at least partially transparent such that the light may be directed therethrough. In one embodiment, the material may be a clear polycarbonate material. When assembled, the boot 170 circumferentially surrounds the light pipes 184. As such, the light pipes 184 may be protected from the external environment by the boot 170. The light pipes 184 are received in the channels 182 such that the front ends 188 are substantially aligned with the front end 178 of the boot 170. The light pipes 184 are received in the channels 182 such that the rear ends 190 are substantially aligned with the rear end 180 of the boot 170. Alternatively, the light pipes 184 may be at least partially recessed within the channels 182 from the front end 178 and/or the rear end 180 of the boot 170. Alternatively, the light pipes 184 may extend at least partially from the channels 182 from the front end 178 and/or the rear end 180 of the boot 170.

When assembled, the boot 170 is coupled to the housing 136 and/or the ferrule 138 such that the front end 178 of the boot 170 engages the cable end 148 of the housing 136. The boot 170 is oriented such that the light pipes 184 are aligned with the light pipe segment 160 of the housing 136. Light emitted from the light pipe segment 160 is received by, and directed through, the light pipes 184. As such, light may be directed from the mating end 146 of the housing 136 to the rear end 180 of the boot 170. Alternative configurations of the light pipe segments 160, 186 are possible in alternative embodiments. For example, the boot 170 may extend to the mating end 146, such that the light pipes 184 receive light directly from the light pipe segment 84 of the receptacle connector 10. Other light pipe segments may be provided between the other segments, such as the light pipe segment 160 in the housing 136 and the light pipe segment 186 defined by the light pipes 184. In another alternative embodiment, the leg portions 158 may extend downward a greater distance such that the leg portions 158 are positioned generally further below the boot 170. As such, the leg portions 158 may be visible from the rear of the plug connector 12. The light pipes 184 in the boot 170 may thus not be needed to see the light emitted from the cable end 148 of the housing 136. Additionally, rather than being aligned with one another along a common axis, the light pipes 184 and/or the leg portions 158 may be non-linear or curved to direct the light to another exterior portion of the plug connector 12.

Figure 5:
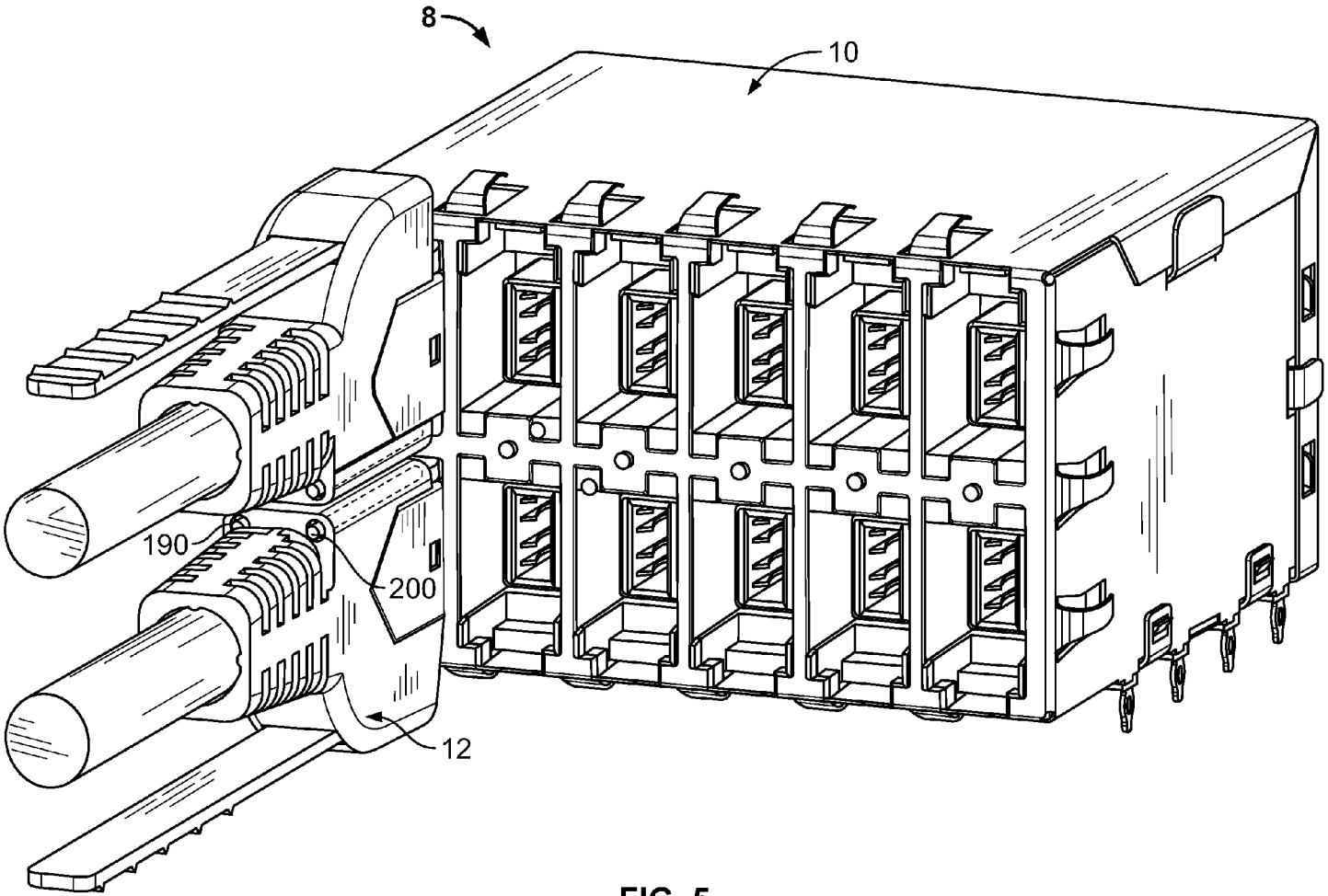
FIG. 5 is a partial assembled view of the connector assembly shown in FIG. 1.

FIG. 5 is a partial assembled view of the connector assembly 8 illustrating two plug connectors 12 mated with the receptacle connector 10. FIG. 5 illustrates the rear portion of the plug connectors 12. The rear ends 190 of the light pipes 184 are visible from the rear portion of the plug connectors 12. The rear ends 190 define indicators 200 that are separate from the light sources 82 (shown in FIG. 3) but that display the light emitted from the light sources 82. As such, the information intended to be displayed by the operation of the light sources 82, such as status information, monitoring traffic, an error or dropped data, and the like, which are typically displayed by the light sources 82 at the face of the receptacle connector, may be observed from the rear portion of the plug connector 12 instead. The indicators 200 are positioned further rearward, and closer to the observer, than with connector assemblies that provide the indicators on the face of the receptacle connectors. Additionally, the plug connectors 12 may be positioned relatively closer to one another as space is not needed on the receptacle connector 10 for a separate indicator. Rather, the indicator 200 is provided on the plug connector 12.

Figure 6:
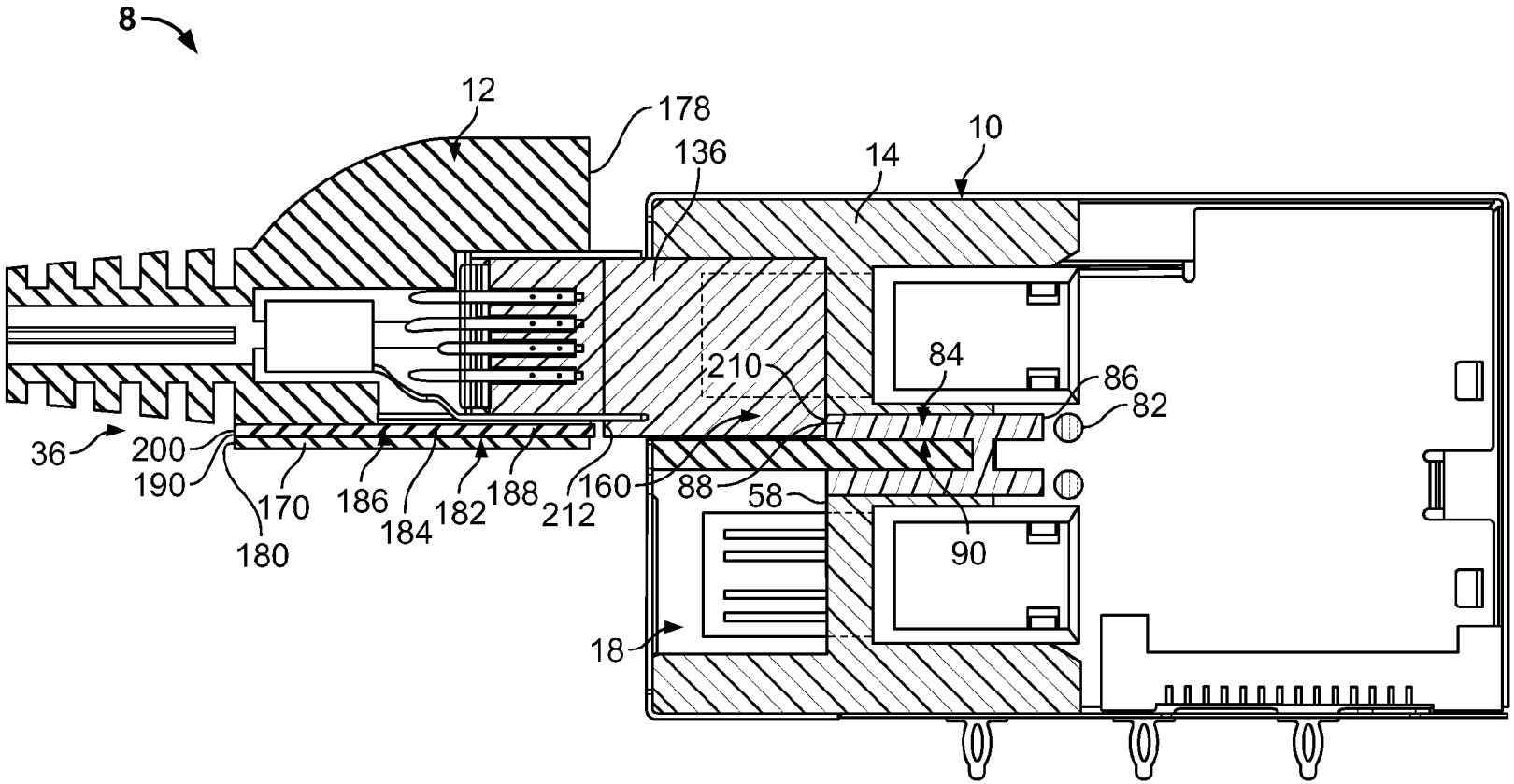
FIG. 6 is a cross-sectional view of the connector assembly.

FIG. 6 is a cross-sectional view of the connector assembly 8 showing an upper plug connector 12 mated with the receptacle connector 10. FIG. 6 illustrates an exemplary embodiment of the light pipe assembly 36 for the upper plug connector 12. A similar light pipe assembly 36 may be utilized with a lower plug connector 12, when included.

The light pipe assembly 36 includes the light pipe segment 84 in the receptacle connector 10. The light pipe assembly 36 also includes the light pipe segment 160 and the light pipe segment 186 in the plug connector. Hereinafter, the light pipe segment 84 may be referred to as the first light pipe segment 84, the light pipe segment 186 may be referred to as the second light pipe segment 186, and the light pipe segment 160 may be referred to as the third light pipe segment 160. The identifiers first, second and third are merely illustrative and intended for clarity and do not impart any particular order or positioning of the light pipe segments.

The first light pipe segment 84 is provided with the receptacle connector 10. The light pipe segment 84 is a separate light pipe element that is coupled to the housing 14. In the illustrated embodiment, the first light pipe segment 84 is integrally formed with the light pipe segment that corresponds with the lower plug connector (not shown), however the light pipe segments 84 may be separate from one another in alternative embodiments. The first light pipe segment 84 is oriented such that the inlet end 86 generally faces the light source 82 and receives light from the light source 82. The inlet end 86 extends outward from the terminating end 44 toward the light source 82. The first light pipe segment 84 extends from through the channel 90 of the housing 14 to the cavity 18. The outlet end 88 of the first light pipe segment 84 is generally flush with the bottom wall 58 of the housing 14 forming the cavity 18.

The third light pipe segment 160 is provided with the plug connector 12. In the illustrated embodiment, the third light pipe segment 160 is integrally formed with the housing 136 of the plug connector 12. For example, the housing 136 may be formed of a material, such as a clear polycarbonate, that allows light to be directed therethrough. In an exemplary embodiment, the third light pipe segment 160 extends between an inlet end 210 and an outlet end 212. The third light pipe segment 160 extends along a linear axis between the inlet and outlet ends 210, 212. The third light pipe segment 160 is substantially aligned with the first light pipe segment 84 and the light source 82. The inlet end 210 faces the outlet end 88 of the first light pipe segment 84 and receives light emitted from the outlet end 88 of the first light pipe segment 84. Optionally, the inlet end 210 may be positioned immediately adjacent the outlet end 88 and/or engage a portion of the outlet end 88. The third light pipe segment 160 directs the light from the inlet end 210 to the outlet end 212.

The second light pipe segment 186 is provided with the plug connector 12. In the illustrated embodiment, the second pipe segment 186 is defined by the light pipe 184 that is a separate element that is coupled to, or otherwise secured by, the boot 170. For example, the second light pipe segment 186 extends through the channel 182 formed in the boot 170. The second light pipe segment 186 is received in the channel 182 such that the front end 188 is substantially aligned with the front end 178 of the boot 170. The second light pipe segment 186 is received in the channel 182 such that the rear end 190 is substantially aligned with the rear end 180 of the boot 170. Optionally, the second light pipe segment 186 may extend along a linear axis between the front and rear ends 188, 190. The front end 188 defines an inlet end that receives light emitted from the outlet end 212 of the third light pipe segment 160. Optionally, the front end 188 may be positioned immediately adjacent the outlet end 212 and/or engage a portion of the outlet end 212. Alternatively, a gap may be formed between the front end 188, or inlet end, of the second light pipe assembly 186 and the outlet end 212 of the third light pipe segment 160. The rear end 190 defines an outlet end that defines the indicator 200 that is observed by the technician. The boot 170 is oriented with respect to the housing 136 such that the second light pipe segment 186 is aligned with the third light pipe segment 160. Light emitted from the third light pipe segment 160 is received by, and directed through, the second light pipe segment 186. As such, light may be directed to the rear end 180 of the boot 170.

Other configurations of light pipe segments may be provided in alternative embodiments of the light pipe assembly 36. For example, the receptacle connector 10 may include more or less segments than the first light pipe segment 84. The plug connector 12 may include more or less segments than the second and third light pipe segments 160, 186. The light pipe segments may be integrally formed with other components of the connectors 10, 12, as with the third light pipe segment 160, or alternatively, the light pipe segments may be separate components that are coupled to, or otherwise secured in place with respect to, the respective connectors 10, 12, as with the first and second light pipe segments 84, 186. The light pipe segments may be linear or may be non-linear. The light pipe assembly may extend from the light source 82 to a rear, external portion of the plug assembly 12, or alternatively, may direct the light to another external or internal portion of one of the connectors 10, 12, such as to a location of the connector assembly 8 that is easily visible by an observer. In the illustrated embodiment, the light pipe assembly 36 directs the light to the rear end of the plug connector 12 as the observer is typically looking at the connector assembly 8 from the rear end of the plug connectors 12. As such, the plug connector 12 does not obstruct the view of the indicator 200, as the indicator 200 is positioned rearward of the plug connector 12. Additionally, because the indicator 200 is not positioned on an external surface of the receptacle connector 10, the plug connectors 12 may be positioned relatively closer to one another.

Figure 7:
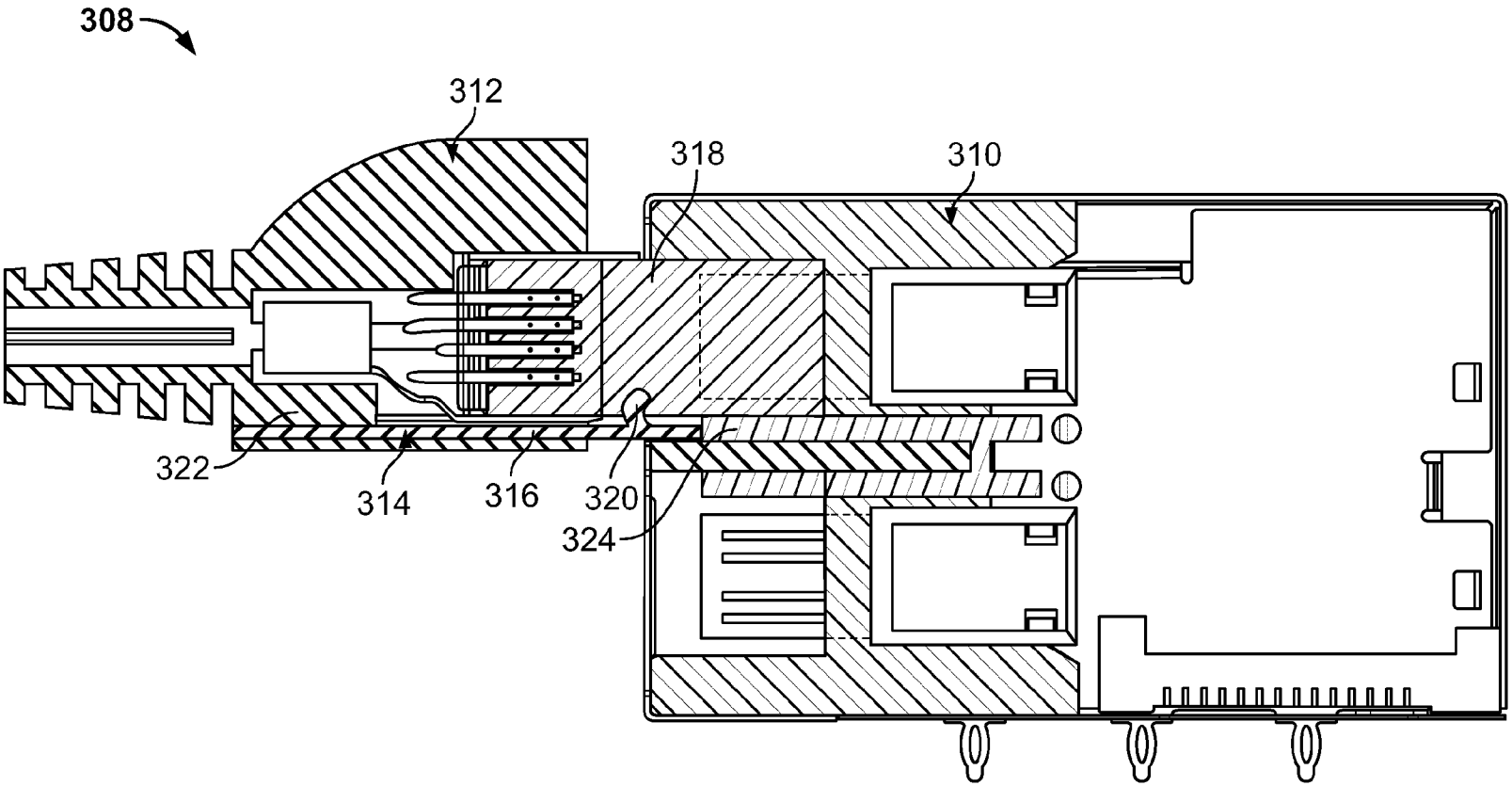
FIG. 7 is a front perspective view of an alternative connector for the connector assembly.

FIG. 7 is a cross sectional view of an alternative connector assembly 308 having an alternative receptacle connector 310 and an alternative plug connector 312. The receptacle connector 310 is substantially similar to the receptacle connector 10 (shown in FIG. 1). The plug connector 312 is substantially similar to the plug connector 12 (shown in FIG. 1). However, the plug connector 312 includes a single light pipe segment 314. The light pipe segment 314 is defined by a light pipe 316 that is coupled to a housing 318 of the plug connector 312. A fastener 320 is used to couple the light pipe 316 to the housing 318. Optionally, the fastener 320 may be integrally formed with the light pipe 316. The light pipe 316 extends into a boot 322 of the plug connector 312 and is visible from a rear portion of the boot 322.

During assembly, the light pipe 316 is coupled to the plug connector 312. The plug connector 312 is then mated with the receptacle connector 310. When mated, the plug connector 312 is positioned such that the light pipe 316 is aligned with a corresponding light pipe 324 of the receptacle connector 310. Optionally, the light pipe 316 may engage the light pipe 324 when the plug connector 312 is mated with the receptacle connector 310.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A connector assembly comprising:

a first connector having a housing and a plurality of contacts extending from the housing, the housing and the contacts defining a mating interface;

a second connector having a housing and a plurality of contacts defining a mating interface configured to mate with the mating interface of the first connector; and a light pipe assembly comprising a plurality of separate light pipe segments associated with the second connector and a light source element associated with the first connector, the light source element being at least one of a light source and a first connector light pipe segment, wherein a first light pipe segment is provided with the second connector and directs light from the light source element, and a second light pipe segment distinct from the first light pipe segment and provided with the second connector and receives light from the first light pipe segment to direct light to an external portion of the second connector.

2. The connector assembly of claim 1, wherein the first connector defines a receptacle and the second connector defines a plug, the second connector having a cable end mounted to an end of a cable, the second light pipe segment directing the light to the cable end.

3. The connector assembly of claim 1, wherein each light pipe segment extends between opposed ends, the first end of the first light pipe segment receives light from the light source element, the first end of the second light pipe segment faces the second end of the first light pipe segment and receives light from the first light pipe segment.

4. The connector assembly of claim 1, wherein the first light pipe segment interfaces with the light source element.

5. The connector assembly of claim 1, wherein the first light pipe segment is integrally formed with the housing of the second connector.

6. The connector assembly of claim 1, wherein the first connector includes a mating cavity receiving the second connector, the light source element being at least partially exposed to the mating cavity.

7. The connector assembly of claim 1, wherein the second connector includes a boot surrounding at least a portion of the housing, the boot having an opening along an external surface thereof, the second light pipe segment being held by the boot and being visible within the opening.

8. The connector assembly of claim 1, wherein the first connector includes a circuit board, the light source element being electrically and mechanically coupled to the circuit board, the circuit board including circuitry for controlling the operation of the light source element.

9. The connector assembly of claim 1, wherein the first light pipe segment is formed integrally with the housing of the second connector, the first light pipe segment being at least partially optically transparent to allow the second light pipe segment to receive light from the first light pipe segment.

10. An electrical connector comprising:

a housing having a mating end and a cable termination end being configured to be coupled to an end of a cable, the mating end configured to mate with a mating connector having a light pipe directing light from a light source;

a boot having a cavity for receiving at least a portion of the housing therein, the boot including a front end and a rear end, the rear end of the boot being configured to be coupled to the cable; and a light pipe extending between the front end and the rear end of the boot, the light pipe being configured to be aligned with the light pipe of the mating connector to direct light from the light pipe of the mating connector to the rear end of the boot.

11. The electrical connector of claim 10, wherein the light pipe abuts the light pipe of the mating connector when the housing is mated with the mating connector.

12. The electrical connector of claim 10, wherein the housing includes a leg portion, the leg portion being aligned with the light pipe and extending between the light pipe and the light pipe of the mating connector when the housing is mated with the mating connector, the leg portion being at least partially optically transparent to allow the light pipe to receive light from the light pipe of the mating connector.

13. The electrical connector of claim 10, wherein the boot includes first and second sides, the light pipe being provided on the first side, a second light pipe being provided on the second side.

14. The electrical connector of claim 10, wherein the boot circumferentially surrounds the light pipe along a length of the light pipe.

15. The electrical connector of claim 10, wherein the light pipe and boot are discrete from one another and formed of materials having different physical characteristics.

16. The electrical connector of claim 10, wherein the boot includes a cable strain relief extending from the rear end, the cable strain relief being coupled to the cable and being flexible to facilitate bending with movement of the cable.

17. A connector assembly comprising:

first and second connectors mated with one another, the first connector having a light source; and a light pipe assembly comprising a light pipe segment separately provided from and received within the second connector, wherein a portion of the second connector is positioned between the light pipe segment and the light source, wherein the portion of the second connector positioned between the light pipe segment and the light source is at least partially optically transparent to allow the light pipe segment to receive light from the light source.

18. The connector assembly of claim 17, wherein the second connector includes a mating end and a cable termination end being configured to be coupled to an end of a cable, the mating end being mated with the first connector, the light pipe assembly directing the light from the light source to the cable termination end of the second connector.

19. The connector assembly of claim 17, wherein the light pipe segment represents a second light pipe segment, the connector assembly further comprising a first light pipe segment received within the first connector, the portion of the second connector positioned between the second light pipe segment and the light source is positioned between the first and second light pipe segments, such portion being at least partially optically transparent to allow the second light pipe segment to receive light from the first light pipe segment.

20. The connector assembly of claim 19, wherein the first light pipe segment, the second light pipe segment and the portion of the second connector positioned between the first and second light pipe segments are aligned with one another along a common axis.

* * * * *